United States Patent [19]

Komatsu et al.

[11] Patent Number: 4,974,658

[45] Date of Patent: Dec. 4, 1990

[54] SHEET SHUTTER

[75] Inventors: Akio Komatsu; Nakayoshi Imada; Shuichi Katsura; Tohru Yoshida, all of Yakumo, Japan

[73] Assignee: Komatsu Denki Sangyo Kabushiki Kaisha, Shimane, Japan

[21] Appl. No.: 313,429

[22] Filed: Feb. 22, 1989

[51] Int. Cl.[5] ..... E06B 9/56

[52] U.S. Cl. ..... 160/310; 160/133; 160/264

[58] Field of Search ..... 160/310, 133, 23.1, 160/264, 271

[56] References Cited

U.S. PATENT DOCUMENTS

| | | | |
|---|---|---|---|
| 3,285,089 | 11/1966 | Tsugawa | 160/310 X |
| 3,430,677 | 3/1969 | Pierce | 160/271 X |
| 3,522,834 | 8/1970 | Corcoran | 160/23.1 |
| 3,750,740 | 8/1973 | Newman | 160/264 X |
| 4,372,367 | 2/1983 | Baldanello et al. | 160/310 |
| 4,615,371 | 10/1986 | Clauss | 160/310 X |
| 4,649,980 | 3/1987 | Kunz | 160/310 X |
| 4,690,195 | 9/1987 | Taylor | 160/310 |

FOREIGN PATENT DOCUMENTS

| | | |
|---|---|---|
| 54-116953 | 8/1979 | Japan . |
| 63-73496 | 5/1988 | Japan . |

*Primary Examiner*—David M. Purol

*Attorney, Agent, or Firm*—Armstrong, Nikaido, Marmelstein, Kubovcik & Murray

[57] ABSTRACT

Disclosed herein is a sheet shutter which is a shutter of the type in which a sheet-form shielding material is lifted and lowered to be used as a partition of the entrance or passage of factory, warehouse or the like. The sheet shutter comprises (a) a pair of sheet guides erected parallel with a predetermined spacing therebetween, each sheet guide having an uppr end; (b) a sheet case provided between the upper ends of the sheet guides; (c) a take-up drum rotatably supported within the sheet case, the take-up drum having an interior space; (d) a flexible sheet having a top edge and both of side edges, the both side edges being guided by the sheet guides in such a manner that the flexible sheet is lifted and lowered, and the top edges being attached to the take-up drum; and (e) a motor for rotationally driving the take-up drum, and motor being fixed to the sheet case and accommodated in the interior space of the take-up drum.

12 Claims, 7 Drawing Sheets

SHEET SHUTTER

BACKGROUND OF THE INVENTION

1. Field of the Invention

The present invention relates to a sheet shutter which is a shutter of the type in which a sheet-form shielding material is lifted and lowered to be used as a partition of an entrance or a passage in a factory, a warehouse or the like, and more particularly to an improvement of a sheet shutter of the type in which the sheet is raised and lowered by means of a take-up drum provided in the upper part of the sheet shutter.

2. Description of the Prior Art

A sheet shutter of the type in which a sheet is raised and lowered by means of a take up drum provided in the upper part thereof, is known and disclosed in Japanese Utility Model Laid Open Publication No. 54-116953.

Such known sheet shutter has two guide rails erected parallel with a predetermined spacing therebetween, which form a part of a shutter frame, and a take-up drum provided horizontally between the upper ends of the guide rails. A flexible sheet is provided between the guide rails so as to be movable in the vertical direction along the guide rails. The sheet is attached at one end thereof on the take up drum driven by a motor. The sheet is raised and lowered by the rotation of the drum, thereby opening and closing the entrance or passage. Such a sheet shutter is structurally simple and mechanically satisfactory.

In such known sheet shutter, a motor for driving the take-up drum is placed in the front or rear side of the upper part of the shutter frame. Because of this, a large protrusion is formed on the partitioning plane of the entrance or passage, obstruction of other works and detraction from the visual appearance. In addition, when the motor is provided on the side or in the upper part of the shutter frame, there are problems, such as it inconvenience in mounting the sheet shutter at the planned position of installation and decrease in the available area in the opening and closing part due to the space taken up by the driving motor.

SUMMARY OF THE INVENTION

With the above-mentioned problems in mind, this invention has been made. It is, therefore, a principal object of the present invention to provided a sheet shutter in which the motor for rotationally driving the take-up drum can be arranged so as not to be in the way when the shutter is installed.

Further, it is another object of the present invention to provided a sheet shutter which can readily be fitted to its installation position and can be made small in size and compact.

In order to achieve the above objects, a sheet shutter according to the present invention comprises: (a) a pair of sheet guides erected parallel with a predetermined spacing therebetween, each sheet guide having an upper end; (b) a sheet case provided between the upper ends of the sheet guides; (c) a take-up drum rotatably supported within the sheet case, the take-up drum having an interior space; (d) a flexible sheet having a top edge and both of side edges, the both side edges being guided by the sheet guides in such a manner that the flexible sheet is lifted and lowered, with the top edge of the sheet attached to the take-up drum; and (e) a motor for rotationally driving the take-up drum, the motor being fixed to the sheet case and accommodated in the interior space of the take-up drum.

According to the present invention, the motor for rotationally driving the take-up drum is accommodated in the interior space of the take-up drum itself so that the motor does not obstruct the installation of the sheet shutter. Further, there is no need for separately providing a specific accommodating space for the motor. Thus, it is possible to make the operating mechanism section of the sheet shutter small and compact, and as a result to secure a sufficiently ample area for the opening and closing part thereof. Furthermore, because the installation of the motor is not visible form the outside, the appearance of the sheet shutter is improved.

In order to accommodate the motor within the interior space of the take-up drum, there is provided a motor case which is disposed in the interior space of the take-up drum in such a way that it will not interfere with the rotation of the drum.

The other objects and advantages of the present invention, as well as the details of the preferred embodiments, will be more fully understood when taken in conjunction with the following drawings, in which:

DETAILED DESCRIPTION OF THE PREFERRED EMBODIMENT

Figure 1:
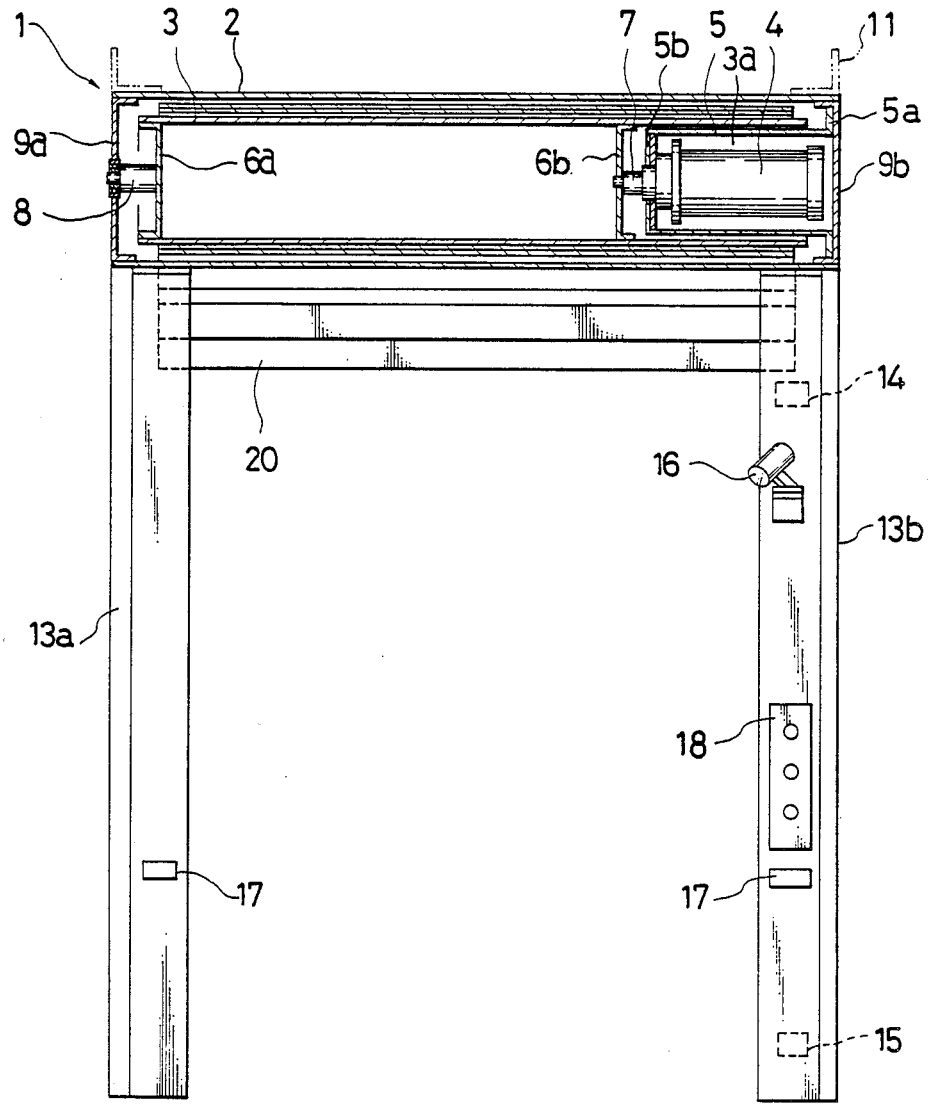
FIG. 1 is a front view with partial cross section of a sheet shutter in accordance with a first embodiment of the present invention.
Figure 2:
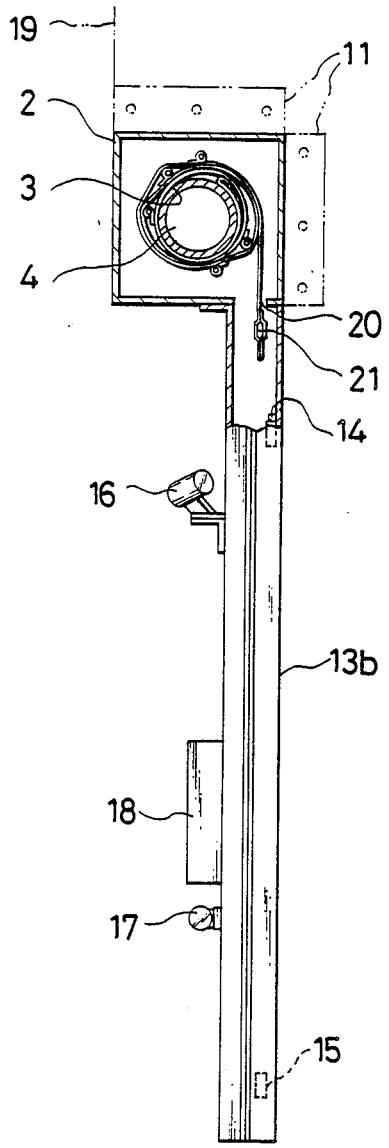
FIG. 2 is a side view partially in section of the sheet shutter.

Referring now to the drawings, a detailed description of a sheet shutter of the present invention will be given.

FIG. 1 is a front view with partial cross section of a sheet shutter in accordance with the present embodiment. In FIG. 1, reference numeral 1 shows a shutter frame which forms the framework of the sheet shutter. The shutter frame 1 has parallel sheet guides 13*a* and 13*b* erected parallel on the left and right sides with a predetermined separation therebetween, and a sheet case 2 bridged horizontally between the ends of the sheet guides 13*a* and 13*b*, which form the shape of a gate as a whole.

The sheet case 2 has an approximately hollow cylindrical form, inside of which there is rotatably disposed a take-up drum 3 in the axial direction therebetween. In addition, on both side of the sheet case 2, there are fitted a first and second plates 9*a* and 9*b*, respectively. On the second end plate 9*b*, there is fixed a flange part 5*a* of an approximately cup-shaped motor case 5. A cylindrical portion of the cup-shaped motor case 5 has a diameter which is smaller than the inner diameter of the take-up drum 3. Therefore, the cylindrical portion of the motor case 5 is accommodated in an interior space 3*a* provided in the end part of the take-up drum 3. In the motor case 5, there is housed and fixed a reversible motor 4 with a brake mechanism. The drive shaft 7 of the motor 4 projects from the inner end face 5*b*, and is fixed to a rib plate 6*b* fastened to the inner surface of the take-up drum 3. On the other hand, a drum shaft 8 is projected via rib plate 6*a* which is also fastened to the inner surface of the take-up drum 3 from the other end of the take-up drum 3. The drum shaft 8 is axially supported rotatably by the first end plate 9*a* fitted to the sheet case 2.

Therefore, the take-up drum 3 is arranged to be rotated within the sheet case 2 by the rotational drive of the motor 4. Further, the cup-shaped motor case 5 is accommodated in the interior space 3*a* of the take-up drum 3 in such a way that it will not interfere with the rotation of the take-up drum 3.

Figure 4:
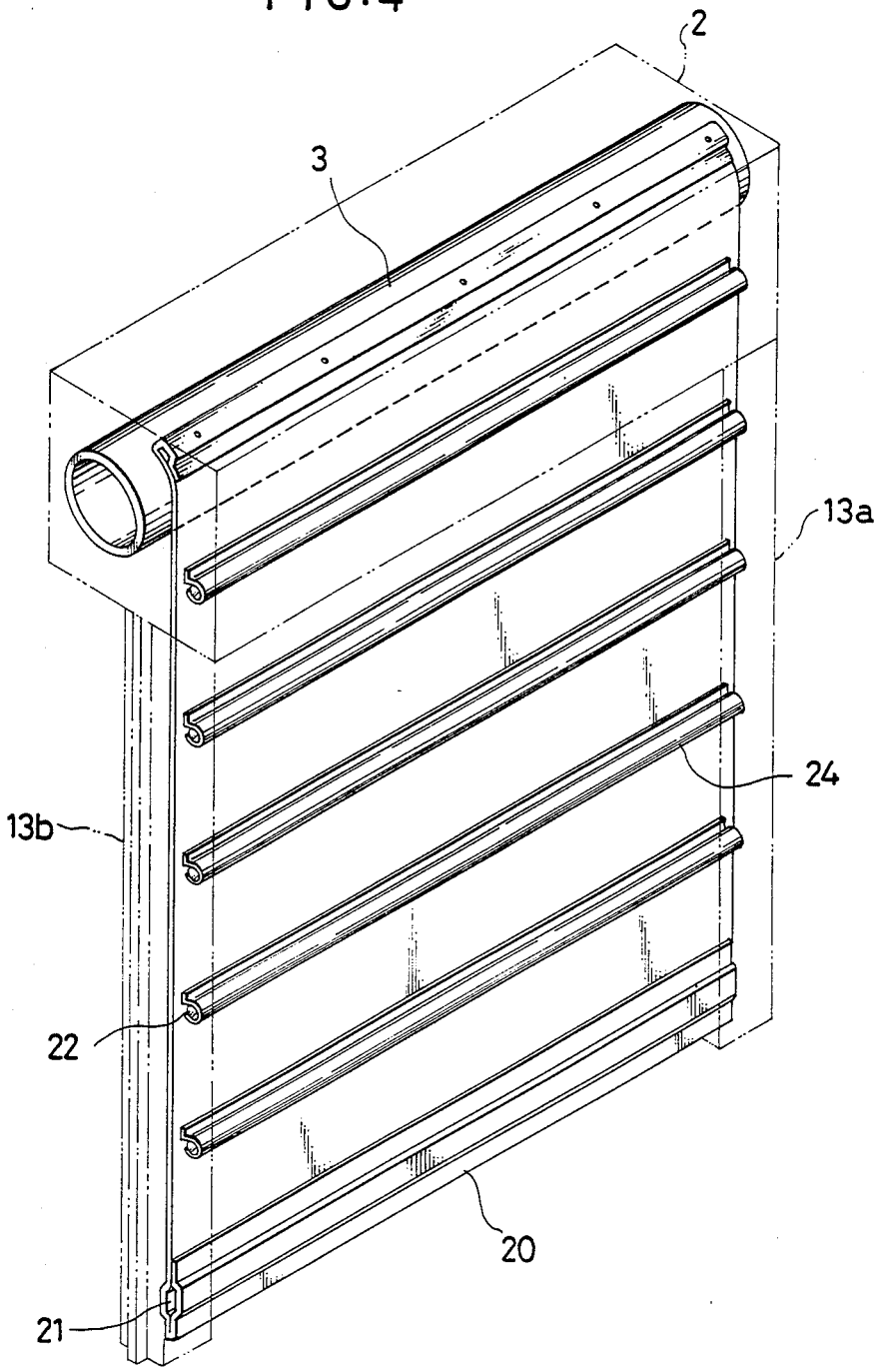
FIG. 4 is a perspective view of the take-up drum and the sheet.

As shown in FIG. 4, the top end of a rectangular flexible sheet 20 formed of a light transmitting and flexible synthetic resin material is fastened to the take-up drum 3 along its axial direction, the sheet 20 is fed out to be lowered and wound up to be lifted by the forward and reverse rotations of the take-up drum 3 by the motor 4.

On the front side of the sheet 20, there are disposed horizontally a large number of tubular pipe housing parts 24 with a predetermined spacing therebetween. In addition, in each of the pipe housing part 24, there is inserted through a support pipe 23 (see FIG. 3) which has a predetermined rigidity and is as light as possible to reinforce the sheet 20 in the horizontal direction thereof. In the figure, reference numeral 22 is a supporting member which supports the support pipe 23 at both ends of the housing part 24.

The spacing between the pipe housing parts 24 of the sheet 20 is set in such a way that when the sheet 20 is wound up around the take-up drum 3, the numerous pipe housing parts 24 each containing a support pipe 23 will not be piled one on the other on the outer circumference of the drum to form an excessively diameter of winding. The spacing between the pipe housing parts 24 can generally be determined computationally based principally on the relation between the diameters of the take-up drum 3 and the support pipe 23 or the like and the length of the sheet 20.

Figure 3:
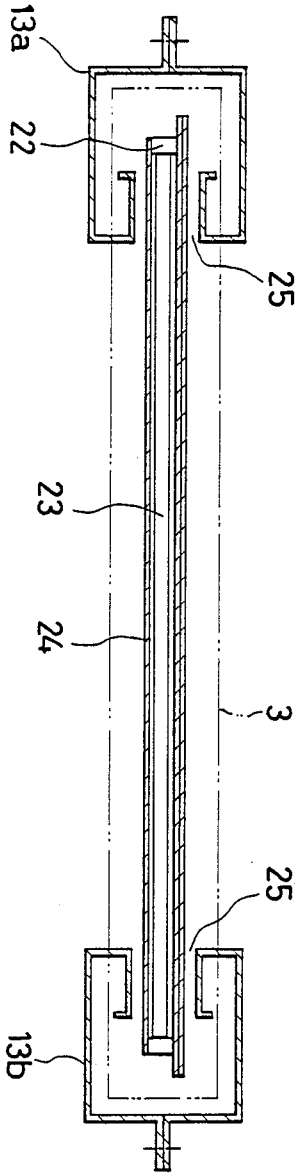
FIG. 3 is a plan view in section of the sheet shutter.

The sheet guides 13*a* and 13*b* on the left and the right are bound by bringing two split guide pieces each consisting a thin plate into the form of a hollow cylinder as shown in FIG. 3. On the inside of each of these guides 13*a* and 13*b*, there is formed a groove-like guide part 25 which accommodates each of both sides of the sheet 20 and guides the sheet freely along the sheet guides. At the bottom end of the sheet 20, FIG. 4, there is inserted through a rod-like sheet weight 21 which realizes a secure touching of the end to the ground by keeping the bottom end straight. Further, the rod-like sheet weight 21 has such functions that gives an overall tension to the sheet 20 that is hung from the take-up drum 3 and smoothes the lifting and lowering of the sheet 20.

Near the upper and lower limit positions of the bottom end of the sheet 20 in the movement of the sheet along the sheet guide 13*b*, FIG. 1 there are provided limit switches 14 and 15, respectively. The limit switches 14 and 15 give a mechanism by which the motor 4 is brought to a stop when the bottom end of the sheet 20 reaches the upper or lower limit position. Further, in the upper front of the sheet guide 13*b*, there is disposed a sensor 16 consisting of an ultrasonic sensor or the like. The sensor 16 points to the front side of the sheet 20 in order to have a mechanism by which the closed sheet 20 will be opened automatically by actuating the motor 4 when a person, a car or the like enters the area in front of the sheet 20.

There are mounted sensors 17 and 17 consisting of photoelectric tube or the like for detecting an obstacle in the lower part of each of the guides 13*a* and 13*b*. The sensors 17 and 17 point to the inside of the entrance in order to prevent the sheet from being lowered by the action of the motor 4 when there exists an obstacle such as a person below the sheet in the opened state of the sheet 20. In FIG. 1, reference numeral 18 is a control box containing electrical equipment, operating buttons and the like for operating the limit switches 14, 15, sensors 17 and the like, attached on the front side of the sheet guide 13*b*.

Figure 5A:
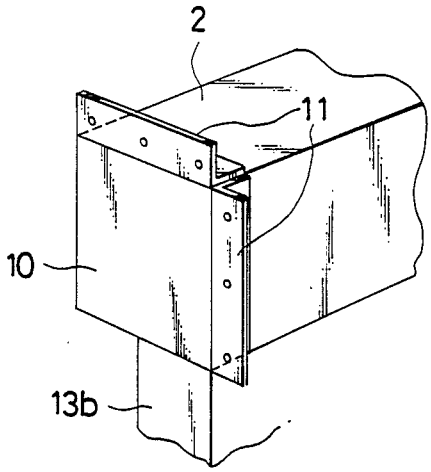
FIG. 5(A) and 5(B) are partial perspective views showing the fitting structures of the sheet shutter.
Figure 5B:
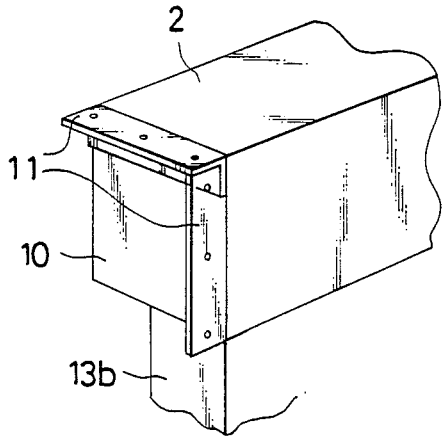

FIG. 5(A) and (B) show an example of structure of the fixture 11 for attaching the sheet case 2 to the passage way of a structure 19 such as a room partition, wall, or the like. In accordance with the structure of the passage way, the fixture 11 with anglelike cross section is attached as shown in FIG. 5(A) or 5(B), and the sheet frame 1 as a whole can be hung by fastening the fixture 11 to the structure.

By having a fixing structure as above, the sheet guides 13*a* and 13*b* do not have to support the entire or almost the entire weight of the sheet shutter, and may be given a construction intended to guide solely the sheet 20. As a result, there can be obtained advantages such as reduction in the weight, improvement in the forming workability by the use of sheet steel or the like, convenience in handling, improvement in the cutting workability for adjusting the height of the gatelike frame, and reduction in the cost and the like.

Figure 6:
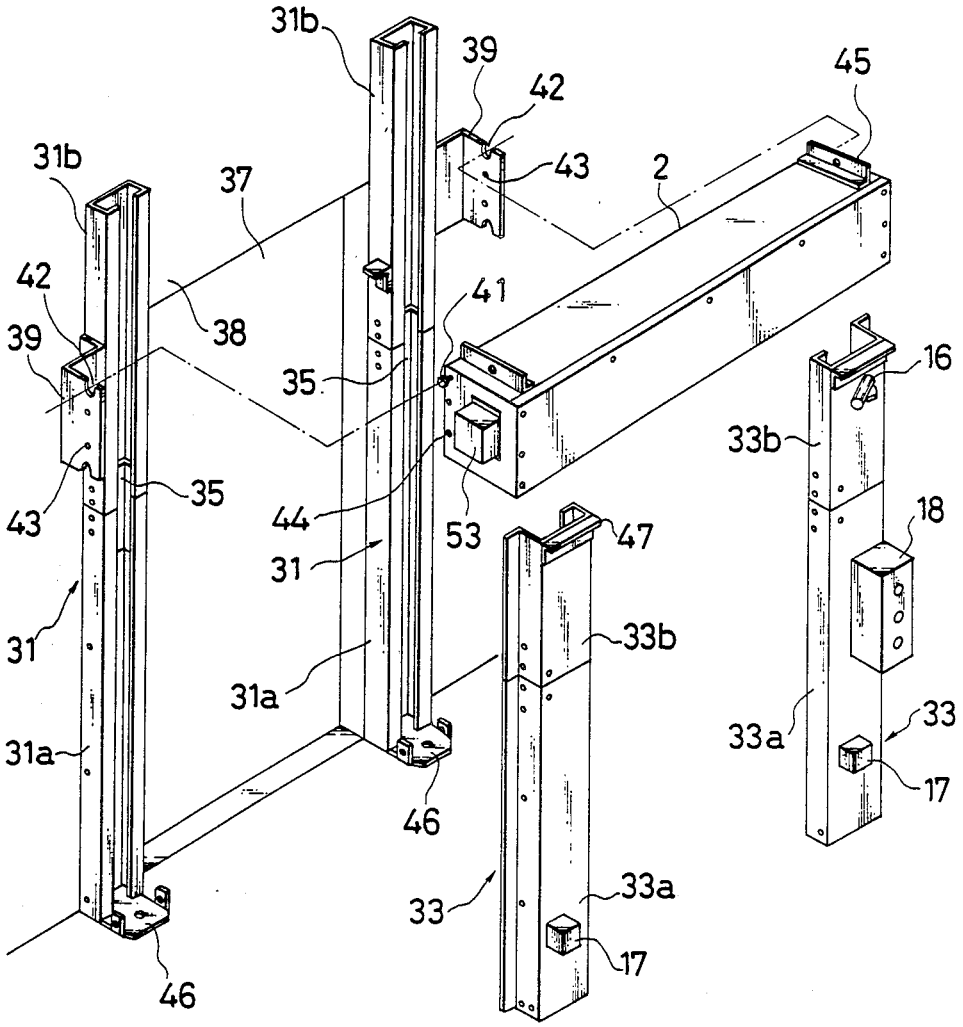
FIG. 6 is a disassembled perspective view showing a whole structure of a sheet shutter of a second embodiment of the present invention.
Figure 7:
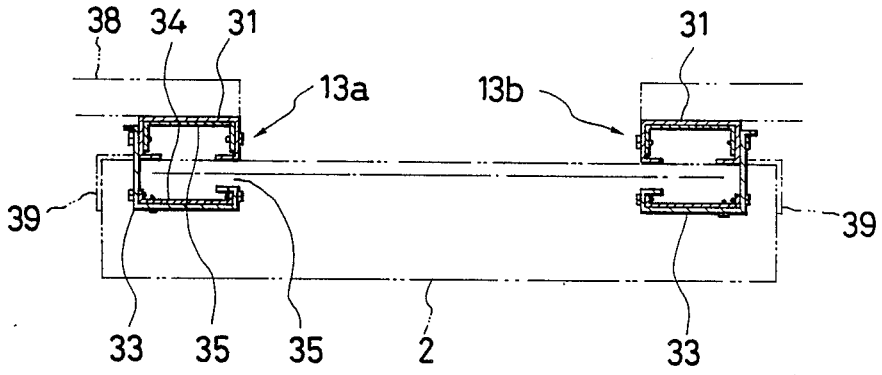
FIG. 7 is a cross sectional view of the sheet guides of the sheet shutter of FIG. 6.
Figure 8:
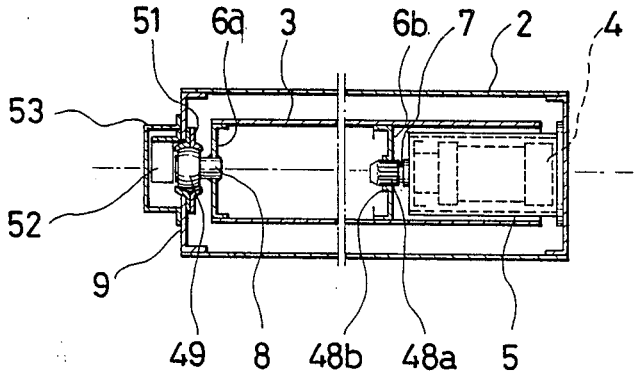
FIG. 8 is a cross sectional view of the sheet case of the sheet shutter.

FIGS. 6 to 8 show the second embodiment of the sheet shutter of the second embodiment of the present invention. The same number used in the drawings to designate the same part in each embodiment.

In these drawings, FIG. 6 is a disassembled perspective view showing a whole structure of the sheet shutter, and FIG. 7 is a horizontally cross-sectional view of the sheet guides of the sheet shutter.

In this embodiment, each sheet guide 13*a*, 13*b* comprises a side frame 31 having a channel shape in cross section and a frame cover 33 assembled with the side frame 31. On the inner side of each sheet guide 13*a*, 13*b*, a groove-shape guide portion 35 is formed along its longitudinal direction in the same manner as the sheet guides of the first embodiment. When the sheet shutter is assembled, the sheet guides 13*a*, 13*b* are positioned symmetrically in such a manner that the guide portion 25 of each sheet guide are opposite to each other. Therefore, both sides of the sheet 20 are guided along the guide portions 25 of the sheet guides 13*a*, 13*b* toward up and down directions.

The side frame 31 of each sheet guide 13*a* or 13*b* comprises an inner frame 31*a* and an outer frame 31*b*. The sheet guide 13*a* or 13*b* is assembled by coupling the inner and outer frames 31*a* and 31*b* with a joint member 35 which is attached on the inner side of the joint portion between the upper and lower frames 31*a* and 31*b* with bolts. Namely, the side frames 31 are formed dividably, so that transportion of the sheet guides into a installation place becomes relatively easy. Thus assembled sheet guide 13*a*, 13*b* are installed on a wall 38 at the installation place.

On the outer side of the upper portion of each sheet guide 13*a*, 13*b*, there is attached a hook member 39 with bolts so as to be adjustable its height with respect to the sheet guide. On the upper portion of each hook member 39, there is formed a receiving recess 42 into which a bolt 41 screwed into the uppermost screw hole provided on each end surface of the sheet case 2 is engaged. On the hook members 39 and the end surfaces of the sheet case 2, there are formed a plurality of apartures 43, 44 so as to have the same pitch therebetween, respectively. The sheet case 2 is assembled with the sheet guides 13*a*, 13*b* by inserting fixing bolts into the corresponding apertures 43 and 44 of the hook member 39 and the end surface of the sheet case 2.

According to the structure described above, when the sheet shutter is installed, the sheet case is lifted by a lift or a crane until the bolts 41 which are preliminarily screwed on the respective side surface of the sheet case 2 are engaged with the receiving recess of each hook member 39, then the sheet case 2 is supported by the hook members 39. Under the condition, the sheet case 2 is fixed to the hook members by other bolts. According to the assembling process described above, the sheet case 2 is safely and easily incorporated with the guide rails 13*a*, 13*b*. As shown in FIG. 6, on both sides of the upper surface of the sheet case 2, there are provided fitting members 45 which are to be hooked by a crane or the like.

Each of the frame covers 33 comprises an upper cover 33*a* and lower cover 33*b* in the same manner as the side frame 31 as described above. The upper and lower covers 33*a* and 33*b* are jointed by a joint member 34 which is fixed to the covers 33*a* and 33*b* by bolts. Thus formed frame covers 33 are fixed to the side frames 31 with bolts, respectively. The lower ends of the frame covers 33 are mounted to bases 46 which are mounted on the lower end of the side frames 31, respectively. On the upper end of each frame cover 33, an angle fixture 47 for mounting the sheet case thereon is provided. The sheet case 2 is mounted on the angle fixtures 47 and then fixed to the sheet guide 13*a*, 13*b*.

Since the other sheet guide also has substantially the same structure as those described above, the detailed description of them is believed to be unnecessary.

FIG. 8 shows a modification of a take-up drum 3 accommodated in the sheet case 2. In this take-up drum 3, a drive shaft 7 of a motor 4 is coupled to a rib 6*a* fastened to the take-up drum 3 by means of a spline. Namely, a spline shaft 48*a* is provided on the drive shaft 7 of the motor 4 and a boss 48*b* into which the spline shaft 48*a* is coupled is formed on the rib plate 6*b*. Further, on the drum shaft 8 which is linked to the rib plate 6*a* fixed to the take-up drum 3, there is provided a barrel bearing 49, and on the end plate 9*a*, a bearing holder 51 having a spherical inner surface into which the barrel bearing 49 is displaceably fitted. Therefore, the barrel bearing 49 is fitted into the bearing holder 51 so as to absorb pivotal displacement therebetween. Further, since the spline shaft 48*a* is axially displaceable to the boss 48*b*, the axial deviation which may be caused between the bearing 49 and the bearing holder 51 can be also absorbed.

As shown in FIG. 8, on the outside of the end plate 9*a* of the sheet case 2, there is provided a limit switch 52 which stops the motor 4 when the sheet 20 is lowered to the lower limit position or when the sheet 20 is lifted to the upper limit position by detecting the number of the rotation of the drive shaft 8. In the drawing, the numeral 53 shows a side cover enclosing the limit switch 52.

It must be understood that the invention is in no way limited to the above embodiments and that many changes may be brought about therein without departing from the true scope of the invention as defined by the appended claims.

What is claimed is:

1. A sheet shutter comprising:

(a) a pair of sheet guides erected parallel with a predetermined spacing therebetween, each sheet guide having an upper end;

(b) a sheet case provided between the upper ends of the sheet guides;

(c) a take-up drum rotatably supported within said sheet case, said take-up drum having an interior space;

(d) a flexible sheet having a top edge and opposite side edges, said side edges being guided by the sheet guides in such a manner that said flexible sheet is lifted and lowered, the top edge of said sheet being attached to said take up drum; and (e) a motor for rotationally driving said take-up drum, said motor being fixed to and supported by one of said sheet guides and accommodated within the interior space of said take-up drum.

2. A sheet shutter as claimed in claim 1, wherein said sheet shutter further comprises a motor case which is fixed to said sheet case, and which is accommodated in the interior space of said take-up drum so as not to interfere with the rotation of said take-up drum, and said motor is accommodated within said motor case and fixed thereto.

3. A sheet shutter as claimed in claim 2, wherein an interior space of said take-up drum has a cylindrical shape, and said motor case is a cup-like member having a cylindrical portion housed within said interior space of said take-up drum in a state making no contact with the interior surface of said interior space.

4. A sheet shutter as claimed in claim 3, wherein said motor case has a flange portion which is fixed to said sheet case.

5. A sheet shutter as claimed in claim 4, wherein said motor having a drive shaft, and said drive shaft of said motor fixed within said motor case projects into the interior space of the take-up drum, and is linked to a driven member fastened to said take-up drum.

6. A sheet shutter as claimed in claim 5, wherein said drive shaft of said motor is coupled to said driven member by a spline for absorbing axial displacement between said drive shaft of said motor and said driven member.

7. A sheet shutter as claimed in claim 1, wherein a plurality of tubular accommodating parts are provided horizontally on said flexible sheet and a lightweight support member with a predetermined rigidity is inserted through each of said accommodating parts.

8. A sheet shutter as claimed in claim 7, wherein spacing between said tubular accommodating parts is set to avoid overlapping of accommodating parts when said sheet is wound around said take-up drum.

9. A sheet shutter as claimed in claim 1, wherein each of said sheet guides comprises a combination of a side frame and a frame cover attached thereto.

10. A sheet shutter as claimed in claim 9, wherein said side frame and frame cover are formed to be dividable into two pieces, respectively, so as to make easy transfer thereof.

11. A sheet shutter as claimed in claim 9, wherein each of said side frames includes a sheet case supporting member adjustable in height positioned with respect to said side frame, and said sheet case is supported by said sheet case supporting members providing said sheet guides, respectively.

12. A sheet shutter as claimed in claim 11, wherein sach of said sheet case supporting members has a receiving recess into which a bolt provided on each end surface of said sheet case is engaged, respectively.

* * * * *